US007762038B2

(12) United States Patent
Ceba et al.

(10) Patent No.: US 7,762,038 B2
(45) Date of Patent: Jul. 27, 2010

(54) BEAM TO COLUMN CONNECTION ASSEMBLY

(75) Inventors: Angel Ibanez Ceba, Navarra (ES); Itziar Lazurtegui Mateos, Navarra (ES)

(73) Assignee: Ibanez Lazurtegui, S.L., Salinas de Pamplona (ES)

( * ) Notice: Subject to any disclaimer, the term of this patent is extended or adjusted under 35 U.S.C. 154(b) by 1045 days.

(21) Appl. No.: 10/597,084

(22) PCT Filed: Dec. 14, 2004

(86) PCT No.: PCT/ES2004/000556

§ 371 (c)(1),
(2), (4) Date: Jul. 11, 2006

(87) PCT Pub. No.: WO2005/068738

PCT Pub. Date: Jul. 28, 2005

(65) Prior Publication Data

US 2007/0163204 A1 Jul. 19, 2007

(30) Foreign Application Priority Data

Jan. 16, 2004 (ES) ..... 200400085

(51) Int. Cl.
*E04C 3/04* (2006.01)

(52) U.S. Cl. ..... 52/653.1; 52/655.1; 52/838

(58) Field of Classification Search ..... 52/838, 52/653.1, 655.1
See application file for complete search history.

(56) References Cited

U.S. PATENT DOCUMENTS

| | | | | |
|---|---|---|---|---|
| 3,685,866 | A * | 8/1972 | Patenaude | 52/655.1 |
| 5,244,300 | A * | 9/1993 | Perreira et al. | 403/263 |
| 5,426,906 | A * | 6/1995 | McCracken | 52/843 |
| 6,739,099 | B2 * | 5/2004 | Takeuchi et al. | 52/289 |
| 6,802,169 | B2 * | 10/2004 | Simmons | 52/653.1 |
| 7,637,069 | B2 * | 12/2009 | Iri et al. | 52/655.1 |

* cited by examiner

*Primary Examiner*—Richard E Chilcot, Jr.
*Assistant Examiner*—Matthew J Smith
(74) *Attorney, Agent, or Firm*—Lucas & Mercanti, LLP

(57) ABSTRACT

The invention relates to a rigid screwed assembly system for metal structures, which is designed to fix secondary sections (3) to a H-shaped receiving section (2) or similar. According to the invention, accessories (1) are provided at the assembly points, said accessories being fitted into the receiving section (2), and the secondary sections are fixed using screwed attachments (4) which pass through the corresponding assembly parts of the sections (2 and 3) as well as the corresponding accessories (1).

6 Claims, 10 Drawing Sheets

BEAM TO COLUMN CONNECTION ASSEMBLY

FIELD OF THE ART

This invention relates to metal structures used in construction, proposing a system of assembling the sections which are arranged as columns and beams in said metal structures, by means of which assemblies are obtained with the rigid consistency of conventional welded assemblies, with an advantageous mounting arrangement by means of screws as in conventional articulated assemblies.

STATE OF THE ART

The use of metal structures as a support frame in building construction is known, using resistant H-shaped sections or similar configurations for forming said structures, such that the assemblies between said sections must be done with the resistance and safety assurances required by the specific mounting in each case.

A system used for the assemblies of the sections of said structures is the rigid assembly system carried out by means of welding, therefore the assemblies are very resistant, but they have the drawback that performing the welds is very expensive, which is even more significant in welds that inevitably have to be carried out in the structure installation site.

Articulated assemblies by means of screwing are used for assemblies requiring less resistance, these assemblies being easy to carry out and mount at the site, so they are used whenever the necessary resistance conditions so allow, nevertheless their limited resistance in many cases does not make them substitutes for the rigid welded assemblies.

OBJECT OF THE INVENTION

According to this invention, a system is proposed which allows carrying out assemblies with the advantages for resistance of rigid welded assemblies and with the advantages of easy mounting of the screwed assemblies, thus overcoming the drawbacks of various conventional solutions, such that it provides very considerable advantages.

This system object of the invention is based on the incorporation of accessories housed between the side flanges and web of the sections that are to receive the assembly of other secondary sections in the structures of application, such that the assembly of these second sections is done by means of screws which pass through the corresponding assembly part of said second sections, together with the part of the receiving sections on which the assembly is carried out and the corresponding part of at least one accessory.

Assembly nodes between the component sections for the structures are thus obtained which have the resistance of rigid welded assemblies due to the extra thickness determined in the anchoring area by the accessories and the resistant distribution of stress that said accessories provide on the entire surface occupied by them. The thickness of the accessories can vary where applicable according to the resistance that is required in the assembly in each application.

Said assemblies carried out with the system of the invention have on the other hand the advantage of the screwed assemblies as regards the mounting because the fastening between the elements of the assembly is carried out by means of screwed anchoring, which can be carried out with relative ease at the installation site once the parts to be assembled have been suitably prepared in the shop, such that the pre-prepared elements are taken to the installation site where only the screwed anchoring must be carried out.

The accessories incorporated in the assemblies according to the proposed system are rigid elements with a basic U-shaped configuration that are can be fitted between the flanges and web of the receiving section of the assembly, such accessories, however, being able to adopt different implementations according to the features of the assemblies to be carried out in each application.

In this sense, the accessories can be, for example, U-shaped with at least one of the side flanges having a greater length than the flanges of the assembly receiver section, so rigid assemblies that are highly resistant in the coinciding parts of the accessories and the receiving section can be carried out, while at the same time being able to carry out assemblies of less resistance by means of anchoring secondary sections directly on the projecting part of the accessories.

When the assemblies require special resistance, the accessories can also be provided with stiffening reinforcements, for example by means of transverse partitions between their flanges perpendicular to the central web, or by means of a prismatic tubular configuration, i.e. with the basic U shape closed by means of a transverse assembly between the ends for the side flanges.

The mentioned system object of the invention is certainly very advantageous, taking on a life of its own and preferably applicable in the function for which it is intended.

DETAILED DESCRIPTION OF THE INVENTION

The object of the invention relates to an assembly system for forming metal building frame structures and the like, for the purpose of carrying out an assembly between the component elements of said structures with the particularities of resistance of rigid welded assemblies but with the ease of mounting of articulated screwed assemblies. This system is useful for the assembly of beam sections on the column sections, and vice versa, in the corresponding structures and it is further applicable with any type of conventional sections used in said structures, such as those of an H-shaped section, an I-shaped section, a U-shaped section, etc.

The system is based on the incorporation of accessories (1) in the areas of the assemblies so as to arrange the anchoring of the corresponding elements (2 and 3) to be assembled in each case by means of screws (4) which are arranged such that they pass through both the respective parts of the elements (2 and 3) which are assembled and at least one accessory (1), which gives the anchoring a resistance making it equivalent to conventional rigid welded assemblies.

Figure 1:
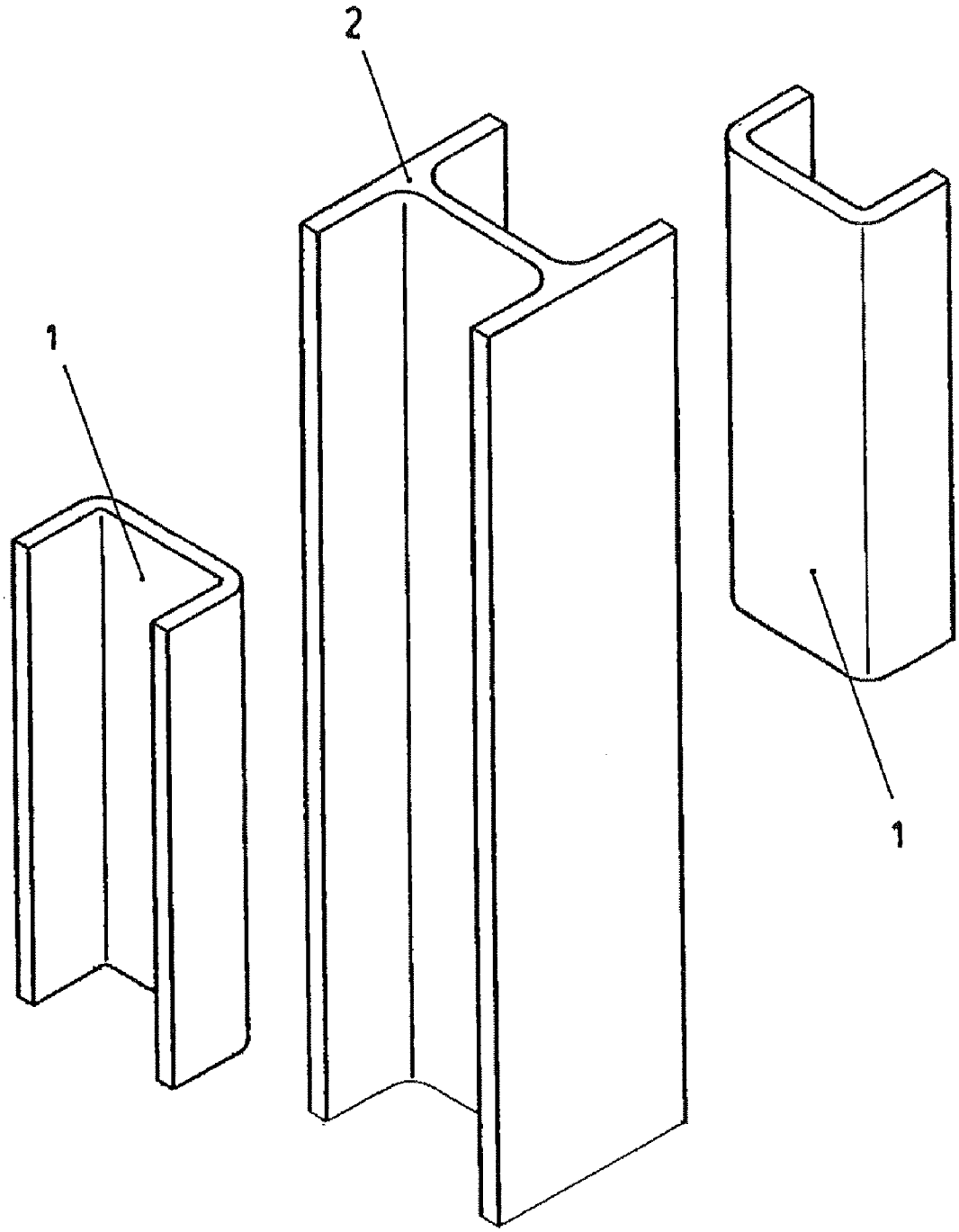
FIG. 1 shows an exploded perspective view of the corresponding accessories on the receiving section of an assembly according to the proposed system.
Figure 2:
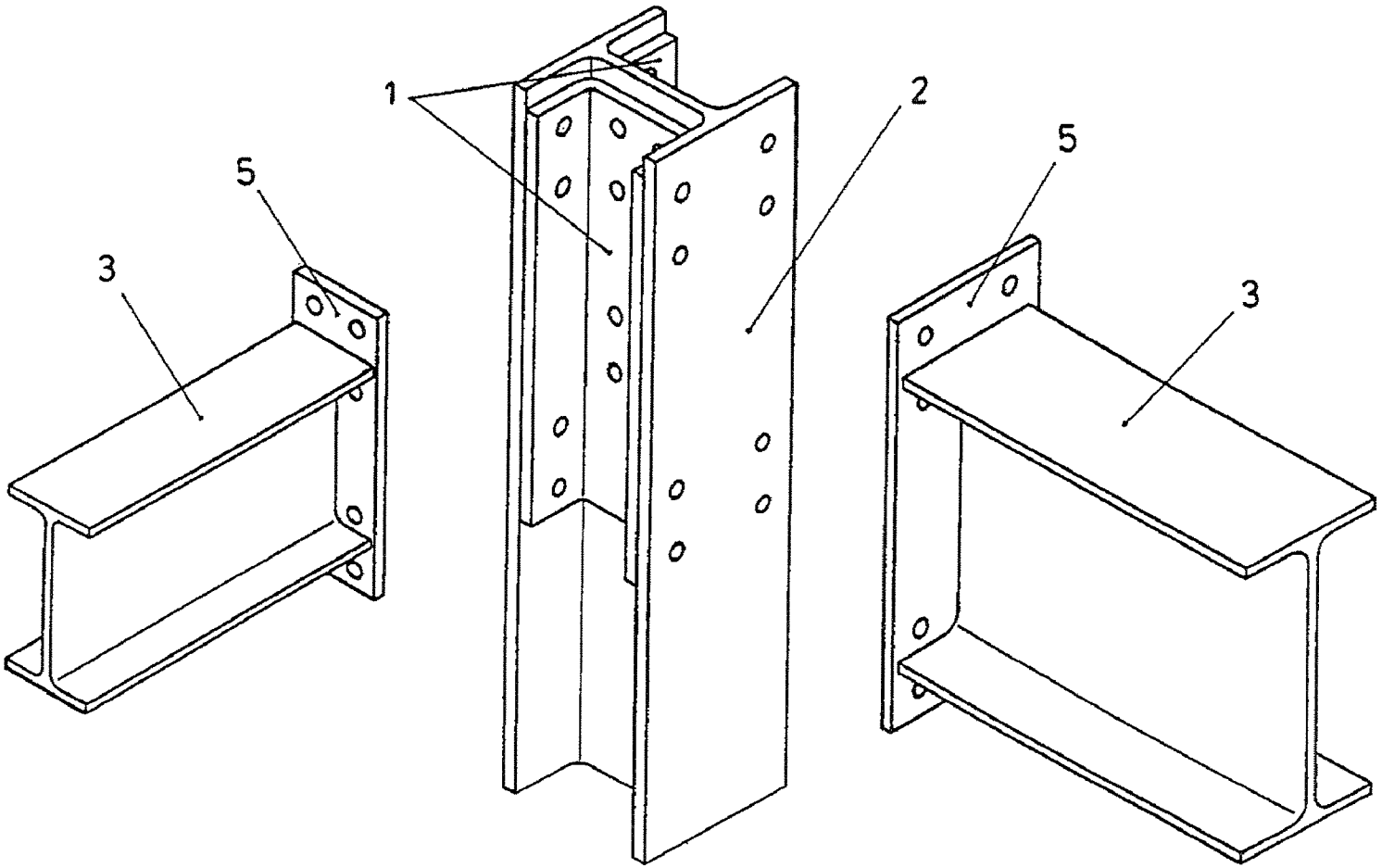
FIG. 2 shows an exploded perspective view of the ensemble of the assembly of two secondary sections on a receiving section according to the mentioned system of the invention.

The accessories (1) used in the application of the system are U-shaped in their most basic implementation, with width and depth dimensions which correspond with the dimensions between the side flanges and the web of the receiving sections (2) which receive the assemblies to be carried out, such that to carry out the fastening of said accessories (1), they are fitted between the flanges and web of the corresponding assembly receiving section (2) as shown in FIGS. 1 and 2.

Figure 3:
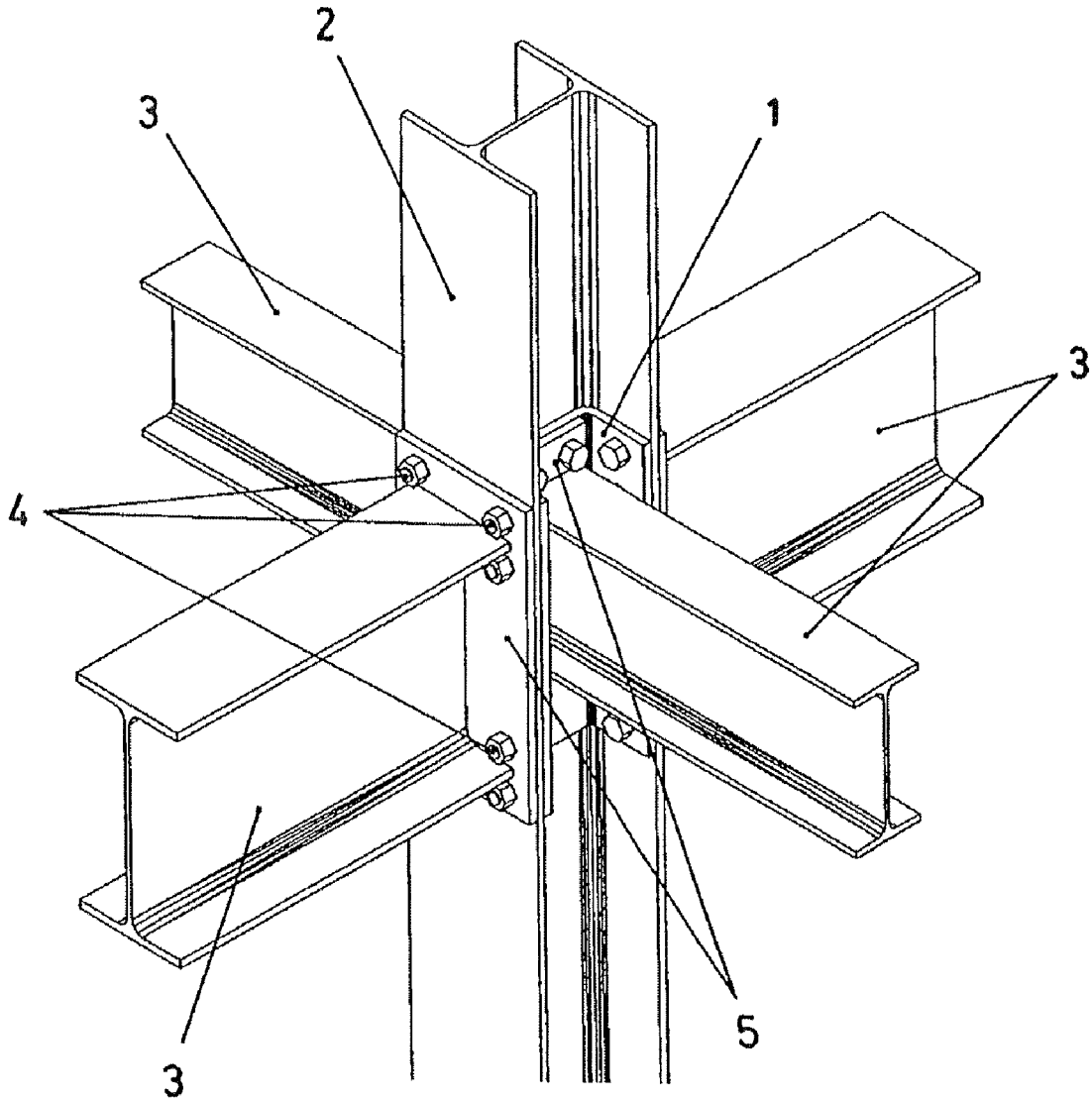
FIG. 3 shows a perspective view of the assembly of four secondary sections on a receiving section according to the arrangement of the previous figure.
Figure 4:
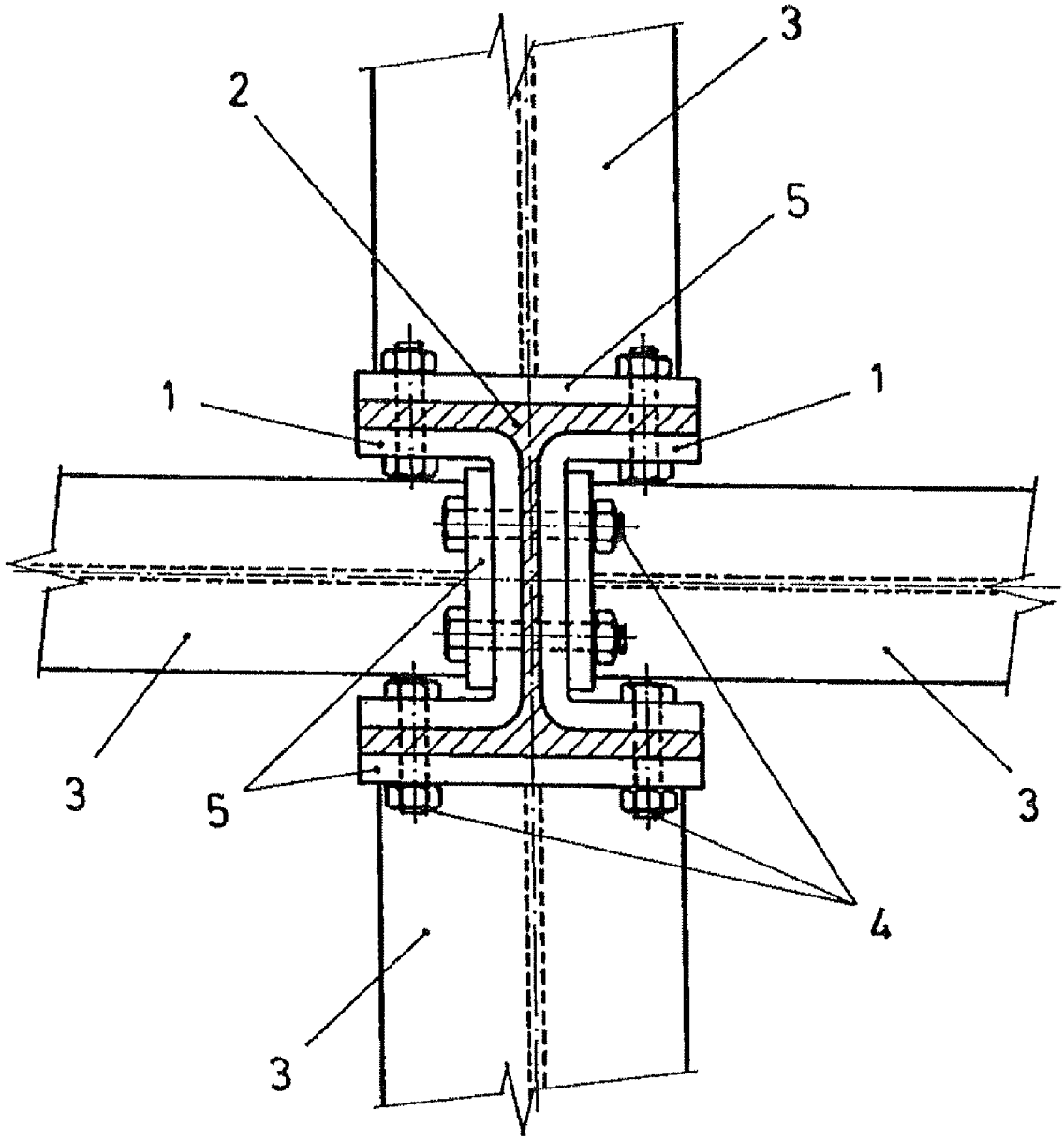
FIG. 4 shows an upper plan view of the assembly of the previous figure.

The sections (3) to be fastened in the assemblies are conventionally equipped with a front plate (5) fixed on their end to form the coupling on the assembly receiving section (2), the fastening being carried out by means of screws (4) which are included through the mentioned plate (5), at the same time passing through the corresponding receiving section (2) and the accessory or accessories (1), as can be seen in FIGS. 2, 3 and 4.

Assemblies are thus obtained in which the anchoring is reinforced by the corresponding accessories (1), which provide extra thickness giving rigidity and distributing the resistant stress throughout the entire area occupied by such accessories (1), such that the resistance must not be supported by the receiving section (2) at any point in the areas in which the screws (4) are applied, so the assemblies are very resistant, being equivalent to the conventional rigid assemblies carried out by means of welding, the walls of the receiving section (2) also being able to be of a relatively reduced thickness.

The assemblies of the secondary sections (3) can be done both on the sides and on the front parts of the receiving section (2), with the only condition that the anchoring plate (5) for the secondary sections (3) is of a suitable width in each case because in front assemblies, said plate (5) must pass between the side flanges of the corresponding receiving section (2) to be coupled to the area of the web of said section (2), as can be seen in FIG. 4.

Figure 5:
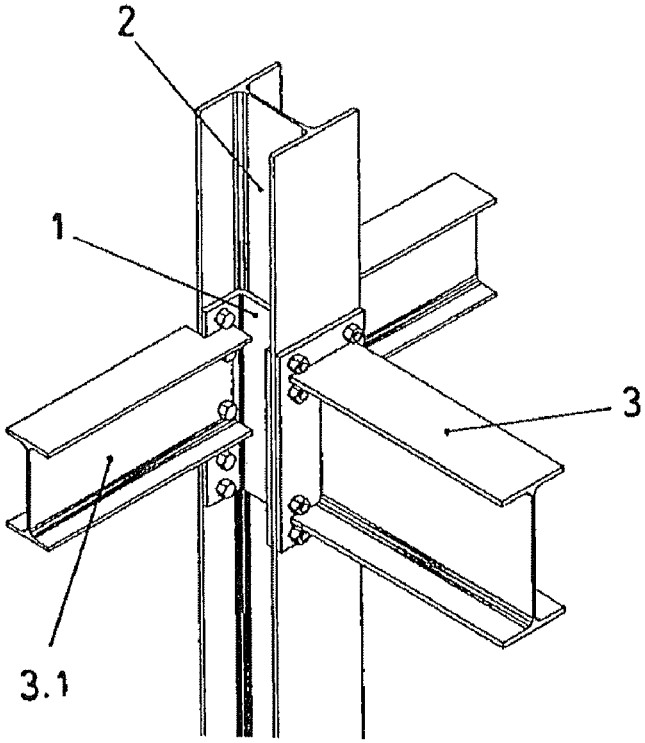
FIG. 5 shows a perspective view of a practical embodiment including other ways of fastening the secondary sections on the receiving section in an assembly which is also part of the scope of the invention.

Assemblies for fastening secondary sections (3.1) directly on the ensemble of the receiving section (2) and the respective accessory (1), without a coupling plate (5), can be formed, as shown in FIG. 5, without altering the scope and with the same resistant anchoring effect.

Figure 6:
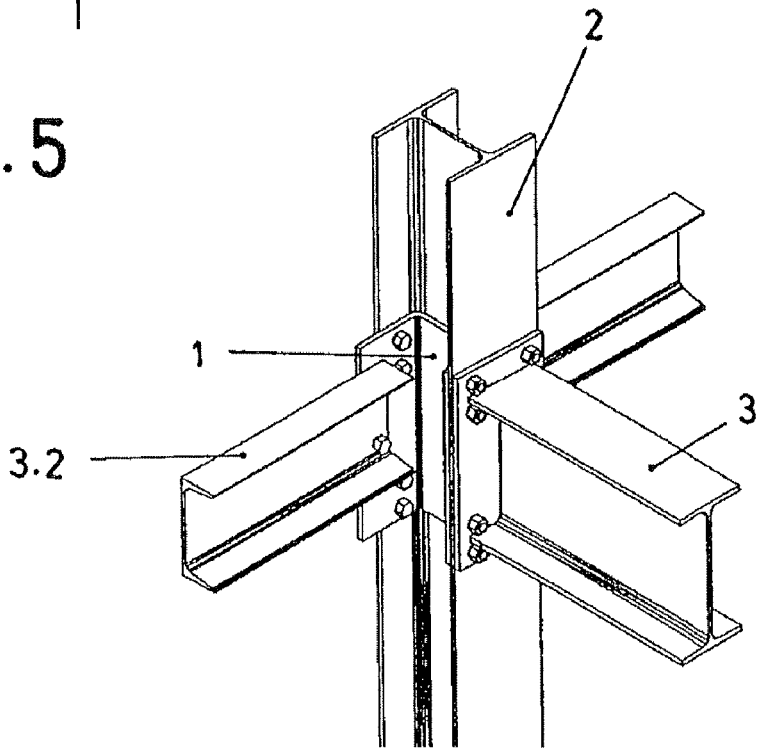
FIG. 6 shows another practical embodiment of a group of assemblies with the system of the invention.
Figure 7:
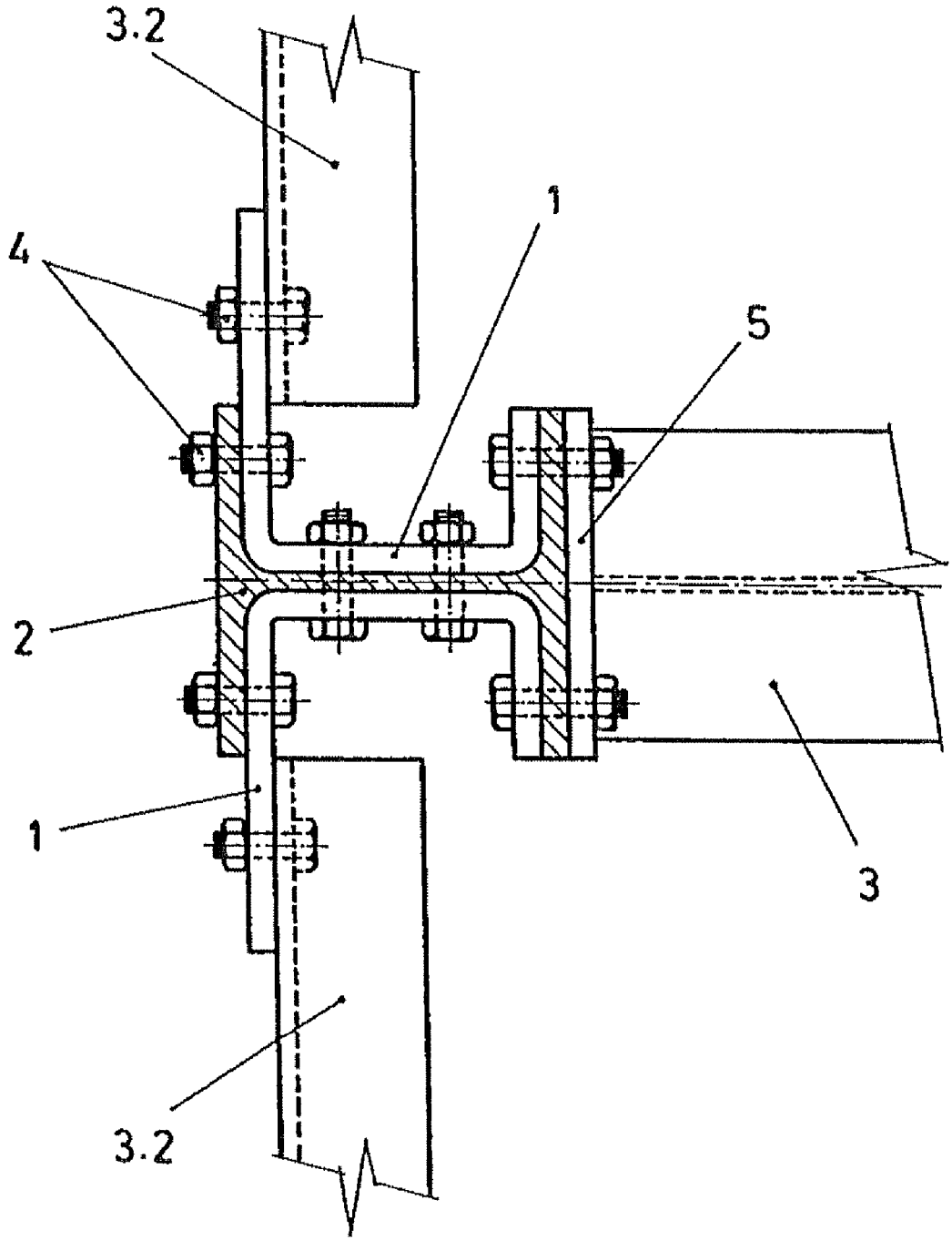
FIG. 7 shows an upper plan view of the ensemble of the previous Figure.

In one embodiment, the accessories (1) can have one or both of its side flanges oversized in length such that in the coupling with respect to the receiving section (2) of the assemblies, part of said flanges projects from the mentioned accessories (1) with respect to the side flanges of the section (2), a lower fastening resistance of secondary sections (3.2) able to be provided directly on said projecting part of the oversized flanges of the accessories, as shown in FIGS. 6 AND 7.

Figure 8:
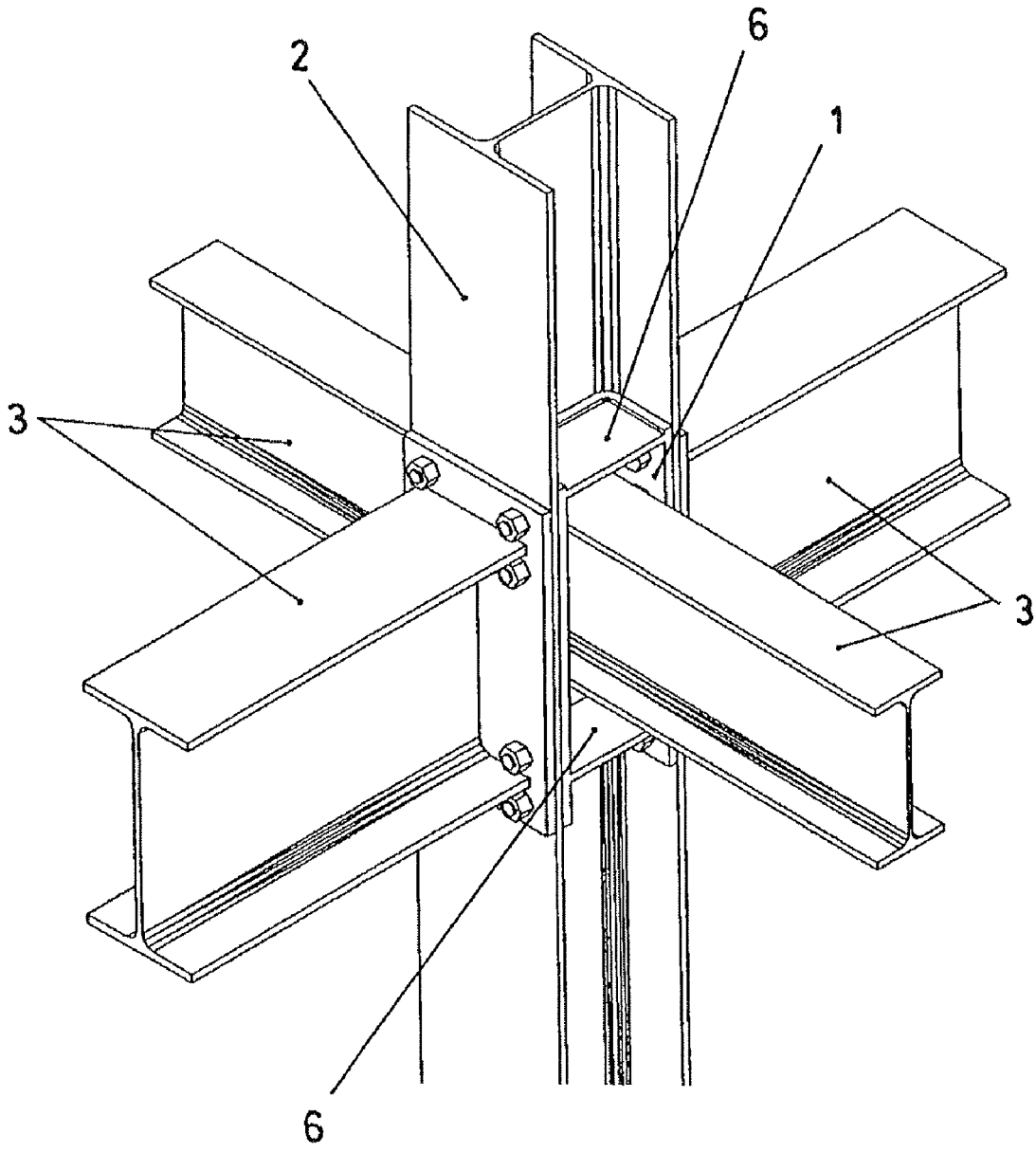
FIG. 8 shows a perspective view of a practical embodiment including an assembly with a reinforced accessory between its flanges.
Figure 10:
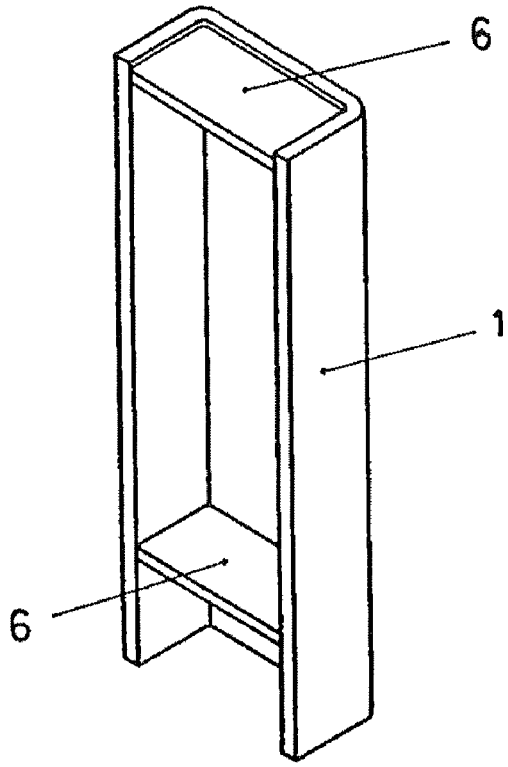
FIG. 10 shows an enlarged perspective view of an embodiment of a reinforced accessory such as the one of the attachment of FIG. 8.

The resistance of the assemblies varies according to the thickness of the accessories (1) that are arranged, such that more or less resistant assemblies can be obtained by incorporating accessories (1) with a different thickness. However, the rigidity and resistance of the accessories (1) may also vary according to other features, for example by means of including transverse reinforcements (6) between the side flanges and perpendicular to the web, as shown in FIG. 10, with which type of accessories (1) the assemblies can however be carried out in the same way as with the simple U-shaped accessories (1) as shown in FIG. 8.

Figure 9:
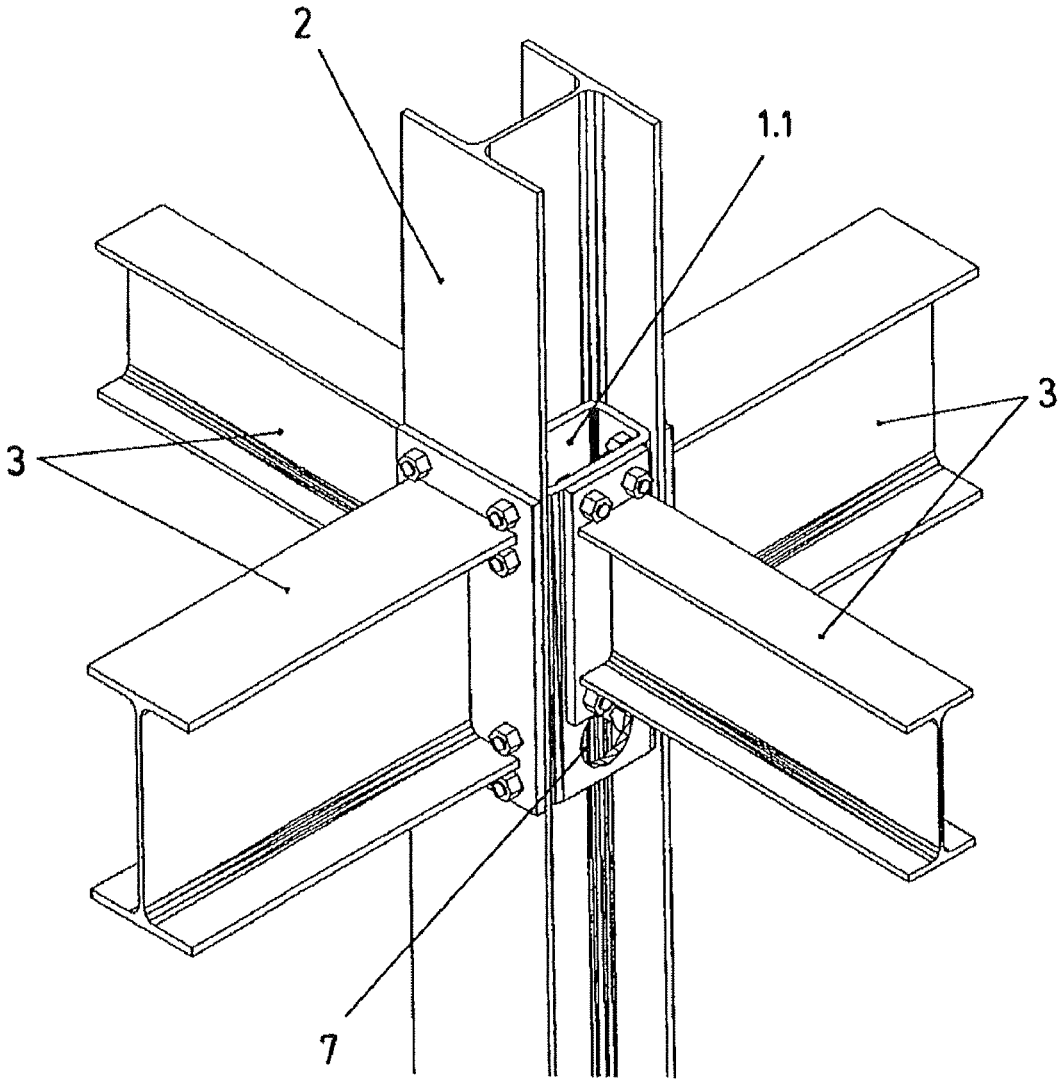
FIG. 9 shows a perspective view of another practical embodiment including an assembly with a tubular-shaped accessory.
Figure 11:
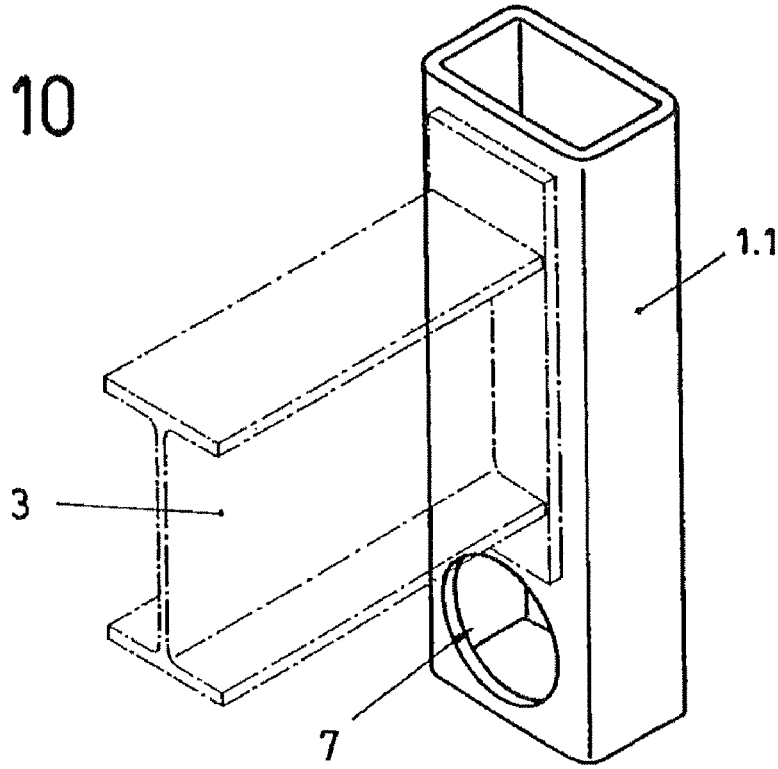
FIG. 11 shows an enlarged perspective view of an embodiment of a tubular accessory such as the one of the attachment of FIG. 9.

In the same sense, tubular-shaped accessories (1.1.), as shown in FIG. 11, can be used in the assemblies within the scope of the invention, also being able to carry out secondary sections (3) with them on a receiving section (2), as shown in FIG. 9. In the case of said tubular-shaped accessories (1.1.), openings (7) for accessing the interior are provided therein so as to facilitate the handling of the mounting of the anchoring screws (4).

Figure 12:
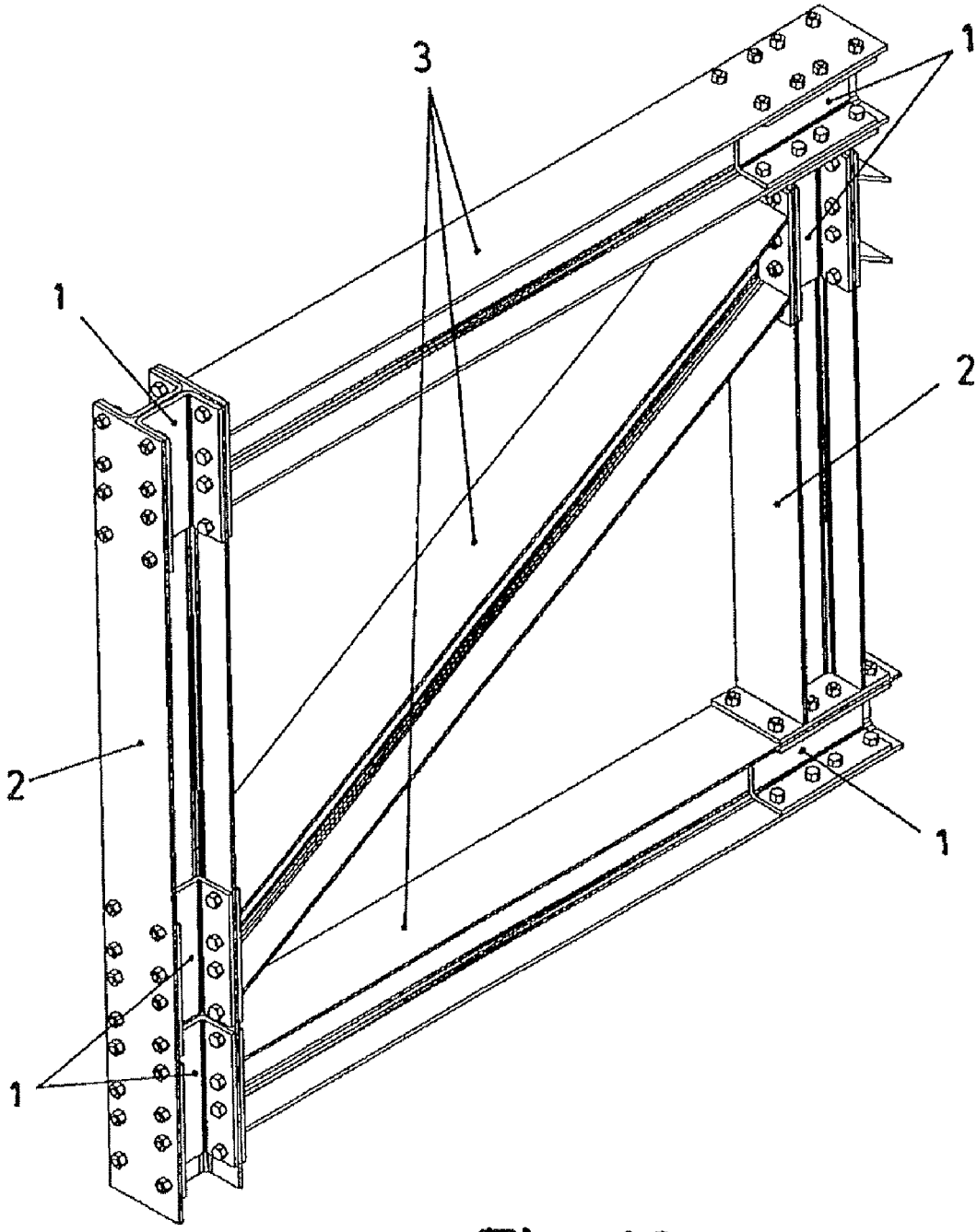
FIG. 12 shows a perspective view of a partial metal structure ensemble carried out with assemblies according to the system of the invention.

In any case, any type of assemblies needed in forming the applicable metal structures can be carried out in any case by means of the system of the invention, based on the incorporation of accessories (1 or 1.1.) in the anchoring assemblies between secondary sections (3) and a receiving section (2), whether coupled on the side or on the front on the receiving sections (2), or with a perpendicular arrangement or an inclined arrangement of the secondary sections (3) with respect to the receiving sections (2), as shown in FIG. 12.

The invention claimed is:

1. A rigid screwed assembly for metal structures for fastening of secondary sections thereon, comprising:

an H-shaped receiving section having side flanges and a web;

U-shaped assembly accessories, which are each a single piece, fitted between and directly contacting the side flanges and the web of the receiving section to form a fastening structure for the secondary sections by means of anchoring screws which pass through the receiving section, the secondary sections and the accessories.

2. The rigid screwed assembly for metal structures according to claim 1, wherein the U-shaped accessories have a prismatic tubular configuration, including openings for accessing an interior to facilitate handling a fastening anchor.

3. A rigid screwed assembly for metal structures, comprising:

an H-shaped receiving section having side flanges and a web;

secondary sections having a front plate fixed at one end; and

U-shaped accessories, which are each a single piece, arranged between and directly contacting the side flanges and the web of the receiving sections, the receiving section, the secondary sections and the U-shaped accessories being coupled by means of screws passing through a plurality of aligned holes in the front plate of the secondary sections, the receiving section and the U-shaped accessories.

4. The rigid screwed assembly for metal structures according to claim 3, wherein the U-shaped accessories have a width corresponding to a gap of side flanges of the receiving section and a thickness that varies according to a degree of rigidity necessary in the U-shaped assemblies to be carried out.

5. The rigid screwed assembly for metal structures according to claim 3, wherein the U-shaped accessories having two side flanges and a web, at least one of the side flanges of the U-shaped accessories have a greater length than the side flanges of the receiving section forming assemblies of secondary sections directly on a projecting part of the side flanges with the greater length of the U-shaped accessories in applied mounting.

6. The rigid screwed assembly for metal structures according to claim 3, wherein the U-shaped accessories have reinforcements between the side flanges and the web of the U-shaped accessories to increase stiffness.

* * * * *